United States Patent [19]

Nix et al.

[11] 4,226,423

[45] Oct. 7, 1980

[54] GAME HAVING ILLUSTRATION-BEARING PROJECTILE

[75] Inventors: Donald F. Nix, Hanover Park; Howard J. Morrison, Deerfield, both of Ill.

[73] Assignee: Marvin Glass & Associates, Chicago, Ill.

[21] Appl. No.: 10,800

[22] Filed: Feb. 9, 1979

[51] Int. Cl.[3] ..... A63F 7/02

[52] U.S. Cl. ..... 273/397; 273/126 R; 273/409; 273/424

[58] Field of Search ..... 273/101, 109, 113, 115, 273/119 R, 126 R, 340, 397, 409, 424

[56] References Cited

U.S. PATENT DOCUMENTS

| | | | |
|---|---|---|---|
| 730,351 | 6/1903 | Dorsey | 273/119 R |
| 1,033,576 | 7/1912 | Garman | 35/28 UX |
| 1,388,265 | 8/1921 | Kehl | 273/115 |
| 2,956,807 | 10/1960 | Luchsinger | 46/239 X |
| 3,254,892 | 6/1966 | Mehelich | 273/101 |
| 3,797,828 | 3/1974 | Ishikawa et al. | 273/126 R |

*Primary Examiner*—Anton O. Oechsle

*Attorney, Agent, or Firm*—Mason, Kolehmainen, Rathburn & Wyss

[57] ABSTRACT

A game apparatus is disclosed including a generally vertically extending playing surface including front and back walls, a projectile launching station, and a projectile receiving station. The front wall of the apparatus bears partial or incomplete illustrations of objects, such as head-less bodies, and the projectiles include illustrations of the missing portions of the objects illustrated on the front playing surface wall, such as the missing heads. The front playing surface wall is generally transparent or includes an aperture at the locations of the missing portions of the illustrations so that when a projectile is launched into the proper location in the projectile receiving station, the projectile will complete the illustration on the front wall of the apparatus. The projectiles are weighted eccentrically to aid in landing the projectiles in the projectile receiving station in an upright position such that the projectiles properly complete the illustrations on the front wall on the apparatus. The launching station includes an air bellows operated propelling device adapted to propel the projectiles toward the projectile receiving station.

12 Claims, 7 Drawing Figures

Fig 1
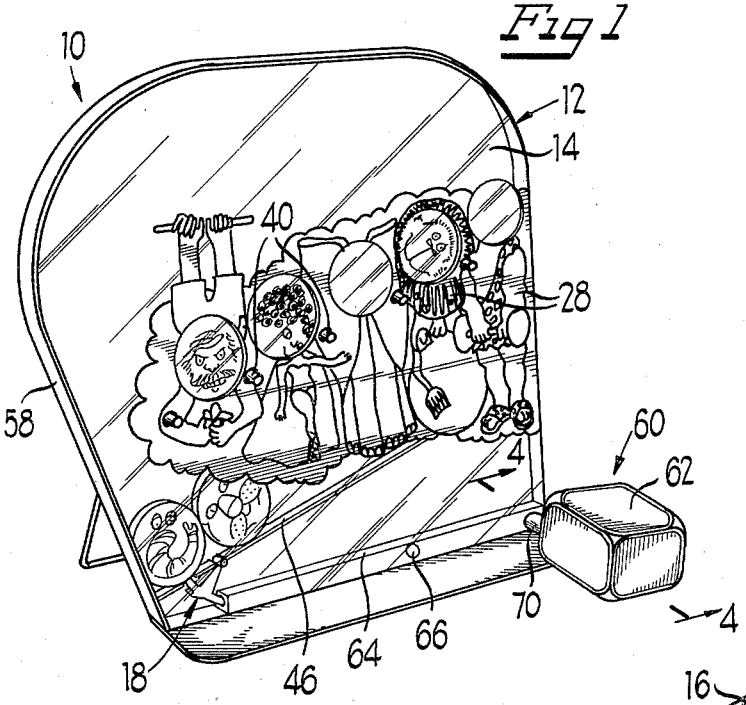
Fig 2
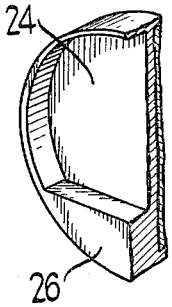
Fig 5
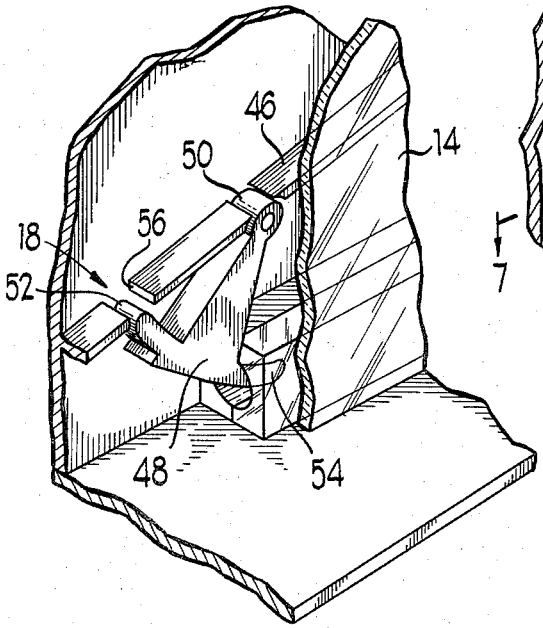
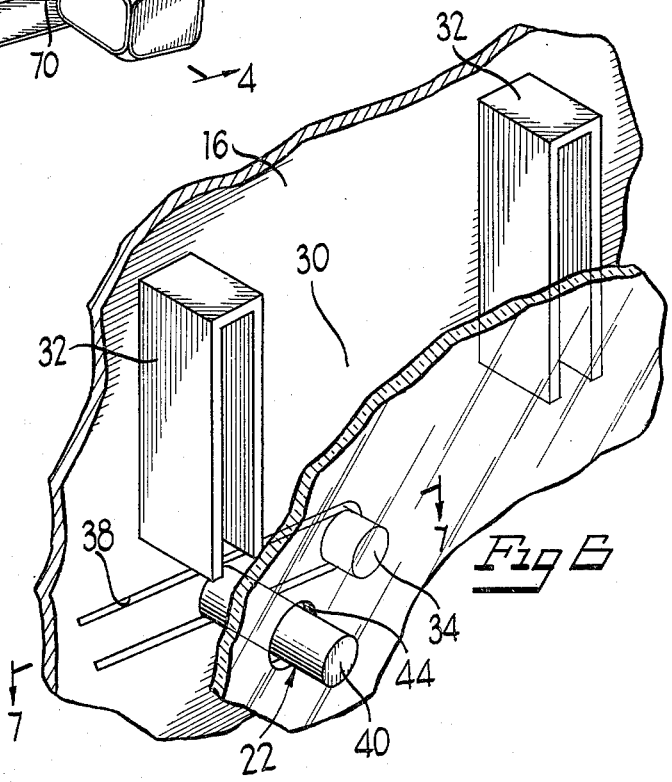
Fig 6
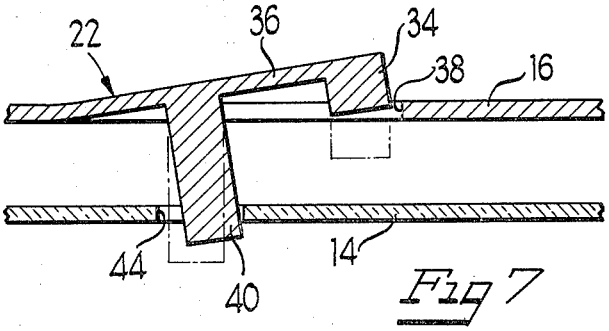
Fig 7

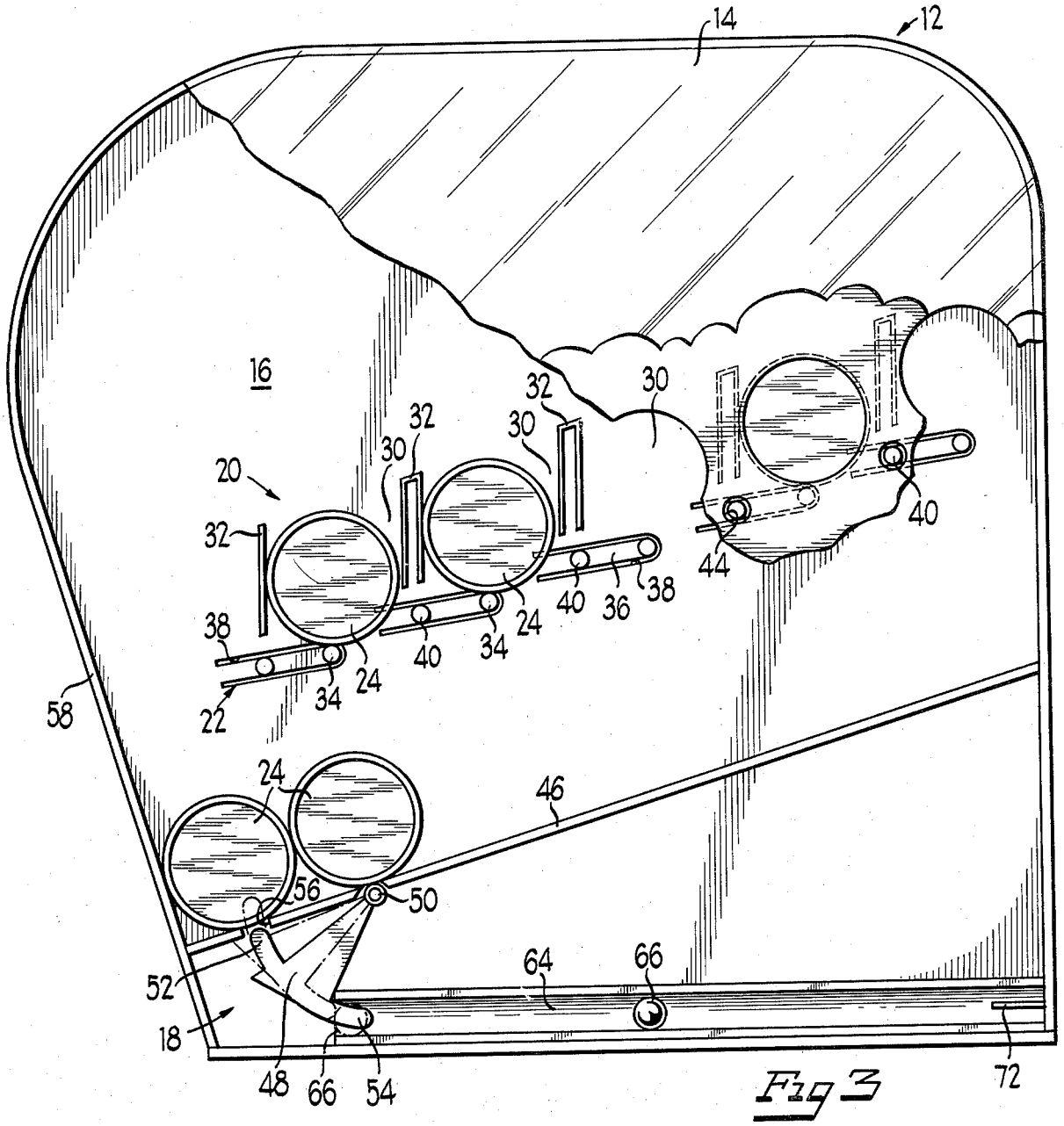
Fig 3
Fig 4
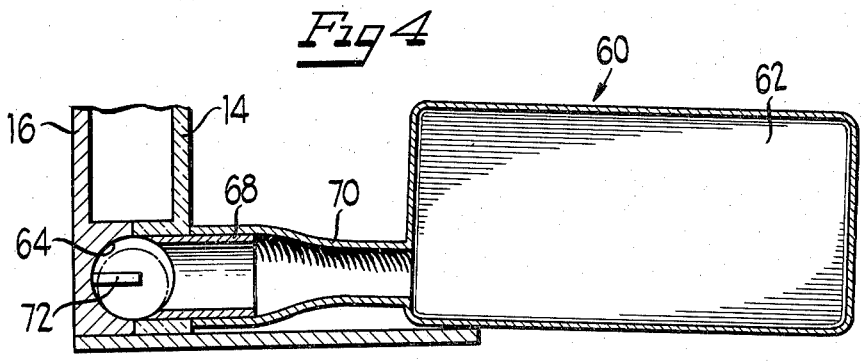

GAME HAVING ILLUSTRATION-BEARING PROJECTILE

BACKGROUND OF THE INVENTION

1. Field of the Invention

This invention relates to a game apparatus in which an incomplete illustration on the front panel is completed by properly propelling an illustrated projectile, such as an illustrated disc, into a proper location in a projectile receiving station. Propelling a projectile into the wrong area of the projectile receiving station will incorrectly, and possibly humorously, fill in the incompleted portion of an illustration on the front panel of the apparatus.

2. Brief Description of the Prior Art

Games are available which propel an object such as a disc into a predetermined area or space such as described in U.S. Pat. No. 3,797,828. Such games do not require the completion of an illustration and therefore do not require that each projectile have only one proper home position in the projectile receiving station. Further, such games do not require a particular at-rest rotational disc position of the projectile in the home station to properly complete an illustration, as is a feature of the invention disclosed herein. In accordance with the present invention, the amount of propelling force applied to a given projectile not only controls the distance that projectile is propelled but also, to some degree, controls the rotational movement of the projectile. The higher the speed of rotation of the moving projectile, the less likely is it that the projectile will come to rest in the projectile receiving station in a proper, upright position to correctly complete an illustration on the front panel of the apparatus.

SUMMARY OF THE INVENTION

An object of the present invention is to provide a game apparatus in which an illustrated projectile is propelled toward a predetermined area or space in a projectile receiving station to complete an unillustrated area on the front panel of the game apparatus.

Another object of the present invention is to provide a game apparatus or amusement device having eccentrically weighted projectiles such as discs, so that gravitational forces acting upon a propelled projectile will tend to seat the projectile in an upright position in the projectile receiving station.

The game apparatus of the present invention generally includes an upstanding playing surface including front and back walls, a projectile launching station, a projectile receiving station, and projectile releasing means adapted to release the projectiles from the projectile receiving station and return the projectiles to the projectile launching station. The front playing surface wall of the game apparatus bears partial or incomplete illustrations of objects, such as head-less bodies, and the projectiles include illustrations of the missing portions of the objects illustrated on the front playing surface wall, such as the missing heads. The front playing surface wall is generally transparent or includes an aperture at each location of the missing portions of the illustrations so that when a projectile is launched into the proper location in the projectile receiving station, the projectile can be seen through the front playing surface wall to complete the illustration thereon.

The projectiles are eccentrically weighted to provide more weight at or near the bottom of the projectile to aid in landing a projectile in an upright position in the projectile receiving station to properly complete an illustration on the front playing surface wall. The projectile launching station and the projectile receiving station are disposed within a substantially vertical housing having front and rear substantially vertical walls. The front wall of the housing is transparent and bears illustrations, preferably on its inner surface, capable of being completed by propelling a projectile into a predetermined area within the projectile receiving station. The projectile receiving station includes a plurality of separated areas, separated by substantially vertical walls to define a plurality of slotted projectile receiving compartments each adapted to receive a single projectile. Each projectile receiving compartment includes a projectile stop member disposed, in operative position, between the substantially vertical walls to hold the projectile within a compartment until the stop member is released. The stop members are capable of being released to disengage a projectile and allow that projectile to fall downwardly back to the projectile launching station.

The launching station includes a projectile engaging pendulum or hammer which provides an angular, rotational and upward force to each projectile when struck by a propelled hammer activating means. In a preferred embodiment, the pendulum is forced into engagement with an undersurface of a projectile by striking the pendulum with a travelling ball which is forced into engagement with the pendulum by hydraulic forces created from an air bellows.

BRIEF DESCRIPTION OF THE DRAWINGS

FIG. 1 is a perspective view of the game apparatus of the present invention;

FIG. 2 is a cut-away perspective rear view of a projectile forming a portion of the game apparatus of the present invention;

FIG. 3 is a partially broken away, enlarged front elevation of the game apparatus shown in FIG. 1;

FIG. 4 is a sectional view of the game apparatus taken generally along the line 4—4 of FIG. 1;

FIG. 5 is an enlarged, fragmentary elevational view of a portion of the game apparatus shown in FIG. 1;

FIG. 6 is an enlarged, fragmentary elevational view of a portion of the game apparatus shown in FIG. 1;

FIG. 7 is an enlarged, fragmentary sectional view of a portion of the game apparatus taken along the line 7—7 of FIG. 6;

BRIEF DESCRIPTION OF THE PREFERRED EMBODIMENT

Referring first to FIG. 1, the game apparatus of the present invention, generally designated 10, is seen to generally comprise an upstanding playing surface housing, generally designated 12 including front wall 14 and rear wall 16; a projectile launching station generally designated 18; projectile receiving station generally designated 20; a projectile releasing mechanism generally designated 22; and a plurality of eccentrically weighted disc projectiles 24 having additional weight 26 on the back side at the bottom of each disc 24 when the disc 24 is in an upright position.

The housing 12 is substantially vertical and includes a generally vertical, transparent front wall 14, and a generally vertical back wall 16 spaced apart from and substantially parallel to front wall 14. The transparent front wall 14 includes incomplete illustrations 28, generally comprising, in a preferred embodiment, headless bodies.

The projectile receiving station 20, best shown in FIG. 3, includes a plurality of projectile receiving compartments 30 separated by substantially vertical wall members 32 extending between the front wall 14 and back wall 16 of housing 12 and substantially vertical to both walls. Disposed below and between each compartment 30 are projectile releasing mechanisms 22, including a projectile stop means 34 which acts to hold a projectile between adjacent walls 32 in a projectile receiving compartment 30 defined by two adjacent vertical walls 32 and a projectile stop means 34 disposed therebelow. The projectile releasing mechanism 22 includes a back wall member 36 hingedly secured to the rear wall 16 of housing 12, the stop member 34 integrally formed with the back wall member 36 and extending vertically outwardly therefrom through an aperture 38 in housing back wall 16 to extend between front and back wall members 14 and 16 of housing 12, as shown in dashed lines in FIG. 7. Projectile releasing mechanism 22 further includes a release button 40 integrally formed with back wall member 36 and extending generally vertically outwardly therefrom through aperture 38 in rear housing wall member 16 and through an aperture 44 in front housing wall 14 so that when the stop release button 40 is forced by hand inwardly toward the back housing wall 16, rear wall member 36 of the projectile releasing mechanism 22 is deflected rearwardly from housing back wall 16, against a biasing force, to thereby remove the projectile stop means 34 from between front and rear housing walls 14 and 16, as shown in FIG. 7. The disc projectiles 24 are able to drop down to launching station 18 when the projectile releasing mechanism 22 is depressed in this manner, to begin a new game or to return an inaccurately launched disc. Released discs fall onto a downwardly sloped projectile return floor member 46, disposed between front wall 14 and rear wall 16 of housing 12, disposed below the projectile receiving compartments 30. The projectile return floor member 46 is sloped downwardly toward the projectile launching station 18 so that each released projectile 24 can be launched again.

The projectile launching station 18 includes a projectile engaging pendulum or hammer 48 hingedly secured by hinge means 50 to the front and rear housing walls 14 and 16 below the projectile return floor member 46. The pendulum or hammer 48 includes a projectile engaging leg member 52 and a pendulum activating leg member 54 for propelling a disc projectile toward the projectile receiving station 20. When the pendulum 48 is activated to propel a projectile toward the projectile receiving station 20, the projectile engaging leg 52 of the pendulum 48 is forced upwardly between a slot 56 in the projectile return floor member 46 to propel the projectile rotationally along an inner surface of a projectile guiding sidewall 58 of housing 12 toward the projectile receiving station 20, and particularly toward a proper projectile receiving compartment 30 to complete a predetermined correct illustration 28 on the front housing wall 14.

The projectile launching station further includes a hammer activating mechanism, generally designated 60 and best shown in FIGS. 3 and 4, including a generally hollow and compressible air bellows 62 in fluid communication with a ball guide path channel 64 to propel a hammer activating projectile 66 into engagement with the pendulum activating leg 54 of the hammer 48 thereby causing the projectile engaging leg 52 of the hammer 48 to propel an illustrated projectile 24 toward the projectile receiving station 20. Air bellows means 62 communicates with the channel 64 by interconnection through conduit 68 disposed substantially perpendicularly to channel 64 by connected of air bellows 62 to horizontal channel 68 through a resilient sleeve 70.

A rib 72 is provided within the elongated ball guide path channel 64 at the air bellows end thereof to set projectile 66 in proper position of alignment to conduit 68. The pendulum activating leg 54 of hammer 48 extends into a hammer activating end of elongated channel 64, as shown in FIG. 3, so that the hammer 48 can be activated by contact with the propelled activating projectile 66, as shown in dashed lines in FIG. 3. The arc of movement of hammer 48 is limited so as to prevent the projectile 66 from leaving channel 64.

The foregoing detailed description has been given for clearness of understanding only and no unnecessary limitations should be understood therefrom as some modifications will be obvious to those skilled in the art.

I claim:

1. A game apparatus, comprising:

a housing;

means defining a front playing surface wall and a projectile receiving station disposed therebehind, said front playing surface wall bearing an incomplete illustration and having a missing portion of said illustration;

a projectile bearing an illustration capable of completing the missing portion of the illustration on said front playing surface wall when projected into said projectile receiving station;

means for orienting the illustration on said projectile with respect to the illustration on said front wall; and launching means for launching said illustration bearing projectile into said projectile receiving station.

2. The game apparatus of claim 1 wherein said housing includes a rear wall and wherein said front playing surface wall is transparent at an area defined by said incomplete portion of said illustration so that said illustrated projectile can be seen through said front playing surface wall to complete said illustration when said projectile is properly propelled into said projectile receiving station.

3. The game apparatus of claim 1 wherein said launching means includes a rotatable hammer including a projectile engaging leg and a hammer activating leg wherein force applied to said hammer activating leg rotates said hammer and thereby forces said projectile engaging leg into engagement with said projectile to propel said projectile upwardly.

4. The game apparatus of claim 1 further including a projectile return means including a sloped projectile floor member disposed under said projectile receiving station, sloped downwardly toward said launching means to return said projectile to said launching means.

5. The game apparatus of claim 1 wherein said means defining a projectile receiving station includes a pair of wall members spaced apart at least as wide as said projectile and disposed above said projectile launching station.

6. The game apparatus of claim 5 further including a releasable projectile stop means disposed between and below said spaced wall members.

7. A game apparatus, comprising:

means defining a projectile receiving station including a plurality of adjacent projectile receiving compartments disposed behind a front playing surface wall, said front playing surface wall bearing an incomplete illustration having a plurality of missing portions of said illustration each missing portion of said illustration disposed at each projectile receiving compartment;

a plurality of projectiles each bearing an illustration capable of completing a missing portion of the illustration on said playing surface wall when the projectile is propelled into a proper one of said projectile receiving compartments;

orienting means on each projectile for orienting the illustration thereon with respect to the illustration on the front playing surface wall; and launching means for launching said illustration bearing projectiles into said projectile receiving compartments.

8. The game apparatus of claim 7 wherein said launching means includes a hinged projectile contacting hammer means adapted to rotate about an axis to strike an undersurface of a projectile to provide an angular, rotation force and an upward force to said projectile.

9. A game apparatus, comprising:

means defining a projectile receiving station disposed behind a front playing surface wall, said front playing surface wall bearing an incomplete illustration;

a projectile bearing an illustration capable of completing the missing portion of the illustration on said front playing surface wall when projected into said projectile receiving station, said projectile being eccentrically weighted to be heavier at the bottom of said projectile when said illustration is in the upright position; and launching means for launching said illustration bearing projectile into said projectile receiving station.

10. A game apparatus, comprising:

means defining a projectile receiving station disposed behind a front playing surface wall, said front playing surface wall bearing an incomplete illustration;

a projectile bearing an illustration capable of completing the missing portion of the illustration on said front playing surface wall when projected into said projectile receiving station; and launching means including an air bellows means in fluid communication with a projectile engaging member and further including an hydraulically movable object contained within a channel, said channel being in fluid communication with said air bellows means such that activation of the air bellows means causes said movable object to move through said channel to strike said projectile engaging member to cause said projectile to be propelled upwardly toward a projectile receiving station.

11. A game apparatus, comprising:

a housing having a rear wall and a front playing surface wall wherein said front playing surface wall is transparent at an area defined by an incomplete portion of an illustration thereon;

means defining a projectile receiving station behind said front playing surface wall adjacent said transparent area;

a projectile bearing an illustration capable of completing the illustration on said front playing surface wall when projected into said projectile receiving station so that the illustration on the projectile can be seen through the transparent area of said front playing surface wall;

a projectile releasing means including a stop means removably disposed between said rear wall and said front playing surface wall below said projectile receiving station to hold a propelled projectile in said projectile receiving station until said stop means is removed from between said rear and front playing surface walls; and launching means for launching said illustration bearing projectile into said projectile receiving station.

12. A game apparatus, comprising:

means defining a projectile receiving station including a plurality of adjacent projectile receiving compartments disposed behind a front playing surface wall, said front playing surface wall bearing an incomplete illustration having a plurality of missing portions of said illustration, each missing portion of said illustration disposed at each projectile receiving compartment;

a plurality of projectiles, each bearing an illustration capable of completing a missing portion of the illustration on said playing surface wall when the projectile is propelled into a proper one of said projectile receiving compartments, said projectiles being eccentrically weighted to be heavier at the bottom of each projectile when the projectiles are in the upright position, said upright position defined as a position such that when seated in a projectile receiving compartment, the projectile properly completes a portion of the illustration on the front playing surface wall; and launching means including a hinged projectile contacting hammer means adapted to rotate about an axis to strike an undersurface of a projectile to provide an upward force to said projectile for launching said illustration bearing projectiles into said projectile receiving compartments.

* * * * *